US006530107B2

(12) United States Patent
Kim

(10) Patent No.: US 6,530,107 B2
(45) Date of Patent: Mar. 11, 2003

(54) FLAT PAINT PAD APPARATUS

(76) Inventor: Song B. Kim, 2312 Via Pinale, Palos Verdes Estates, CA (US) 90274

( * ) Notice: Subject to any disclaimer, the term of this patent is extended or adjusted under 35 U.S.C. 154(b) by 0 days.

(21) Appl. No.: 09/900,731

(22) Filed: Jul. 6, 2001

(65) Prior Publication Data

US 2003/0005536 A1 Jan. 9, 2003

(51) Int. Cl.[7] ..... B05C 17/00
(52) U.S. Cl. ..... 15/210.1; 15/145
(58) Field of Search ..... 15/210.1, 145

(56) References Cited

U.S. PATENT DOCUMENTS

| | | | | |
|---|---|---|---|---|
| 2,810,148 | A | | 10/1957 | Wood, Jr. |
| 2,853,731 | A | | 9/1958 | Lancaster |
| 3,359,589 | A | | 12/1967 | Moore |
| 3,605,165 | A | | 9/1971 | Burns |
| 3,708,821 | A | | 1/1973 | Chase et al. |
| 4,127,911 | A | | 12/1978 | Cupp et al. |
| 4,658,461 | A | * | 4/1987 | Roe |
| 5,117,527 | A | | 6/1992 | Milkie |
| 5,209,781 | A | | 5/1993 | Milkie |
| 5,331,710 | A | * | 7/1994 | Tollasepp |
| 5,495,635 | A | | 3/1996 | Williams |
| 5,556,470 | A | | 9/1996 | Gruber |
| 5,933,905 | A | | 8/1999 | Hess |

* cited by examiner

*Primary Examiner*—Randall E. Chin
(74) *Attorney, Agent, or Firm*—Fulbright & Jaworski L.L.P.

(57) ABSTRACT

A paint pad apparatus having a mounting plate for attaching a removable paint pad and handle. The mounting plate has a plurality of projections for aligning, receiving, and blocking a shaft of the handle. The projections allow the shaft of the handle to be freely rotatable. The paint pad apparatus also is also provided with a plurality of accessible spacers to allow application of paint to a surface adjacent an adjoining surface.

18 Claims, 5 Drawing Sheets

FLAT PAINT PAD APPARATUS

FIELD OF THE INVENTION

The present invention relates generally to an apparatus for painting and in particular to a paint pad on which the mounting plate carries a paint pad on one side and has projections on the other side to which a handle is removably attached to the mounting plate.

BACKGROUND OF THE INVENTION

Currently, painters use brushes or rollers to paint large wall surfaces in an efficient manner. However, using brushes or rollers to paint to the edge of a wall surface, without painting the adjacent wall surface is extremely difficult, if not impossible. These paint applicators necessitate frequent renewal by reapplying the tape to the surface adjacent the surface being painted or require re-painting of the edge of the surface being painted, at considerable expense and effort. Several devices have been developed to solve this problem.

One device is a paint pad that is coupled to a flat mounting plate. The mounting plate has four spacer means that extend beyond the mounting plate, each spacer means extends beyond at least two edges of the paint pad. A disadvantage of such device is that mounting plate substantially covers the spacer means, thus making it very difficult to sufficiently clean the spacer means if paint is picked up by the spacer means, which prevents the spacer means from rolling if desired and causes the spread of paint on the spacer means to spread to the adjacent surface.

Another device is a coating pad device having projections on one side of the pad for locking the shaft of the handle in one of three positions. One disadvantage of such device is a lack of means for neatly painting the edges between two surfaces. Another disadvantage of such device is a lack of flexibility for the paint handle's motion, since the handle is locked in one of only three positions. A further disadvantage of such device is that the support shaft has to be snapped into the locking projections, which would be difficult if projections had paint on their surfaces, particularly when the paint pad was removed and replaced with a new paint pad. Yet a further disadvantage of such device is a lack of a projection on one side with the locking projections, (a stop block) which would rest directly at the end of the support shaft and restrict the motion of the handle along its axis with respect to the pad.

Another type of device uses a flat pad having a fixed blade along one edge of the pad. During loading of the pad, paint is unavoidably applied to the edge. Paint must then be wiped from the edge before applying paint to the adjacent surface. The result is that the paint operation becomes messy and wasteful.

The previous devices do not provide for a clean painted line between adjacent surfaces at the same time allowing quick and efficient access to spacer for cleanup and allowing for a fully rotatable handle coupled to a paint pad, wherein the paint pad does not slip perpendicular with respect to the motion of applying paint with the paint pad.

SUMMARY OF THE INVENTION

The present invention provides a paint pad apparatus for applying paint to a surface comprising: a mounting plate, preferably in the shape of a rectangle, having a top and a bottom face; a paint pad attached to the bottom face of the mounting plate; a plurality of upwardly extending projections attached along the top face of the mounting plate, the projections having internal cavities capable of supporting an end portion of a shaft of a handle; a stop block projection attached along the top face of the mounting plate, to stop the end portion of the shaft of the handle; and a plurality of spacers rotatably attached along the top face of the mounting plate for maintaining the paint pad apparatus at a uniform distance from a surface adjacent the surface being painted. At least two spacers extend outwardly beyond at least two sides of the mounting plate and at least two spacers extend outwardly beyond one side of the mounting plate. The alignment projections, the upwardly extending projections, and the stop block projection are preferably integrally attached to the top surface of the mounting plate.

In a further embodiment of the invention the paint pad apparatus comprises at least two alignment projections attached along the top face of the mounting plate to allow alignment of an end portion of a shaft of a handle.

In yet a further embodiment the paint pad apparatus comprises a plurality of tabs along the bottom face of the mounting plate, the tabs extend inwardly along at least two opposing peripheral edges of the mounting plate to allow mounting of the paint pad.

These and other features, aspects, and advantages of the present invention will become better understood with regard to the following detailed description and accompanying drawings.

DETAILED DESCRIPTION OF THE INVENTION

Figure 1:
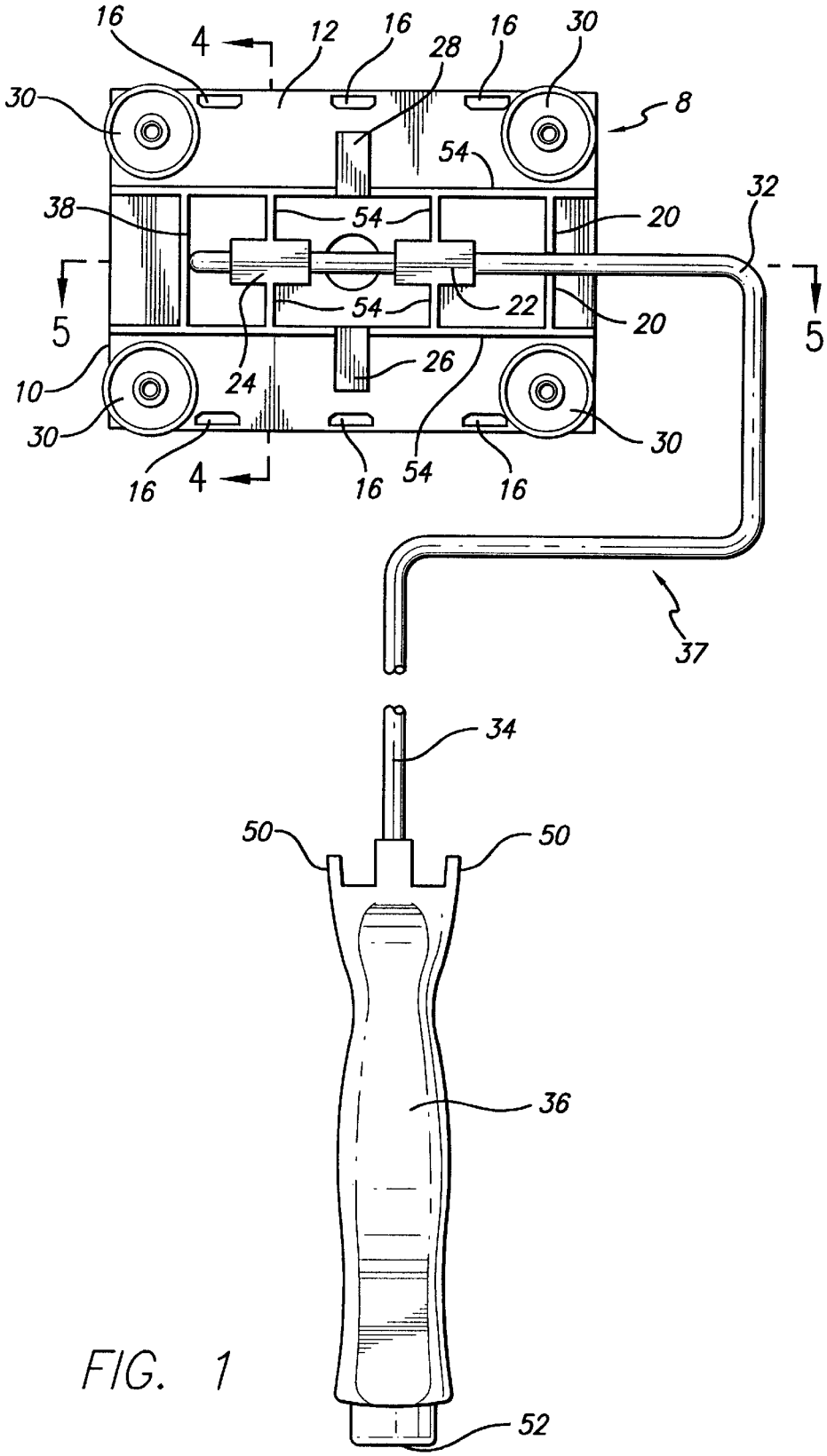
FIG. 1 is a top view of the paint pad apparatus, showing the shaft of the applicator handle going through a first and second upwardly extending projections.
Figure 2:
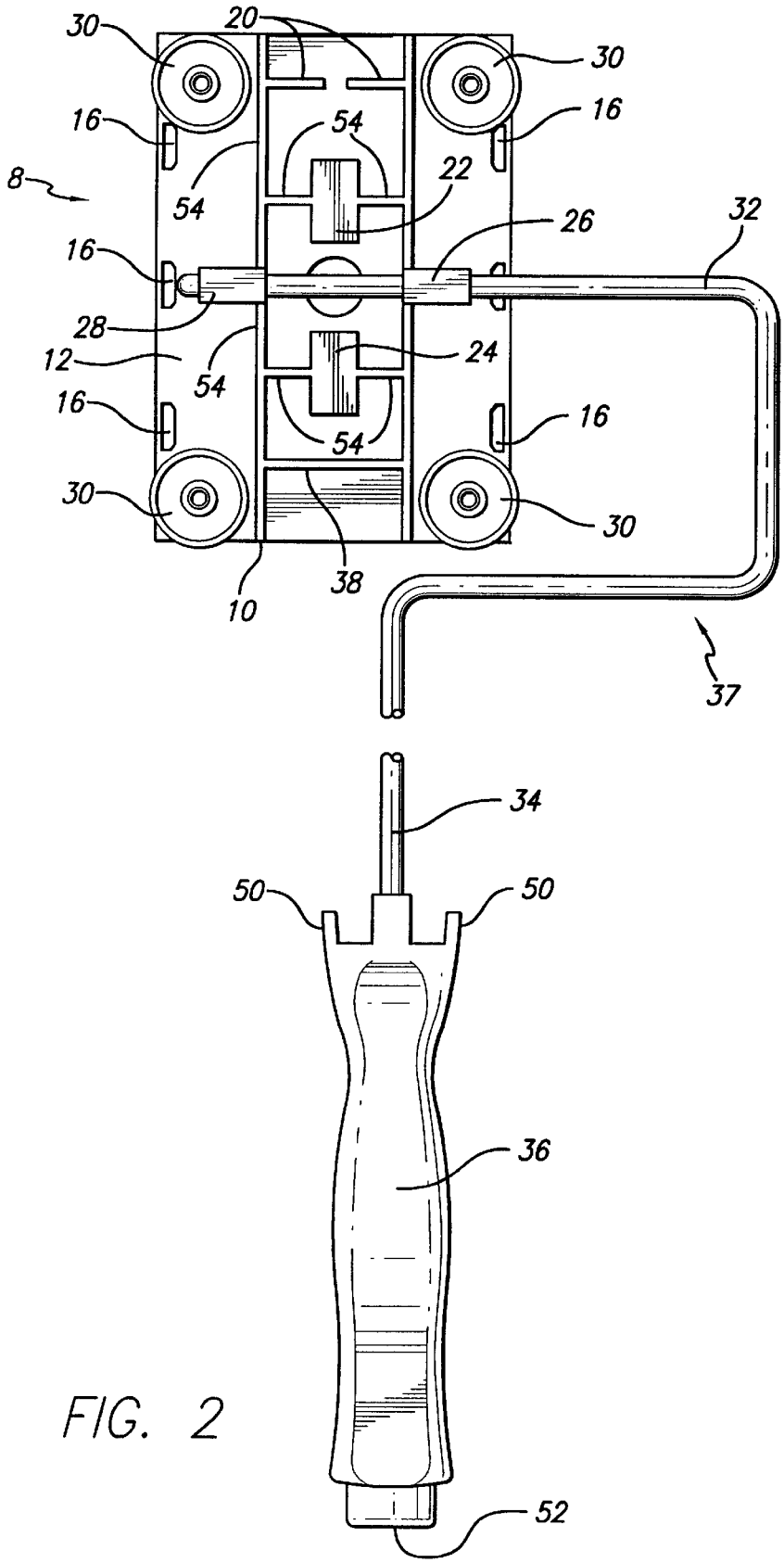
FIG. 2 is a top plan view of the paint pad apparatus, showing the shaft of the applicator handle going through a third and fourth upwardly extending projections.

In accord with the present invention a generally flat pad is provided, adapted to carry a small amount of paint and apply it to a surface or to advance paint already on a surface. The paint pad includes those pads commercially available and known as "brush pads," "pile brush pads," and "pile brushes."

With reference to FIGS. 1–6, a paint pad apparatus 8 comprises a mounting plate 10 having a top surface 12 and a bottom surface 14. The mounting plate 10 is typically made of plastic, such as polypropylene, polyethylene, nylon, acetal, Kapetal, or m27. The mounting plate is preferably made from a material that has some rigidity so that when pressure is applied to the plate during the painting application, the plate is able to equally distribute the pressure over the entire plate. The top surface 12 has at least one alignment projection 20 extending upwardly from the top surface 12. Preferably, there are at least two alignment projections 20 extending upwardly from the top surface 12, the projections 20 aligned adjacent one another and having a space between each other about the width of a shaft 32 of a handle 37.

The top surface 12 also has a plurality of upwardly extending projections 22, 24, 26, and 28. The upwardly extending projections 22 and 24 are aligned along one axis of the mounting plate 10, the upwardly extending projections 26 and 28 are aligned along the other axis of the mounting plate 10, i.e., the axis of the extending projections 26 and 28 is at an angle of 90° with respect to the axis of the extending projections 22 and 24. Both axes of the upwardly extending projections 22, 24, 26, and 28 lie preferably along the center of the mounting plate 10. The plurality of upwardly extending projections 22, 24, 26 and 28 have preferably a plurality of support projections 54 on their sides. The support projections 54 provide an additional rigid support to the projections 22, 24, 26, and 28 to prevent them from breaking off of the mounting plate 10.

Each upwardly extending projection has an internal cavity to support a shaft 32 of a paint handle 37. The alignment projections 20 allow for alignment of the shaft 32 of the handle 37 prior to the shaft's entrance into and through the internal cavities of the upwardly extending projections 22 and 24. The top surface 12 also has a stop block projection 38 which stops an end of the shaft 32 after the shaft has entered the upwardly extending projections 22 and 24. The stop block projection 38 prevents shifting of the mounting plate 10 with respect to the paint handle 37, while allowing the shaft 32 to be freely rotatable with respect to the mounting plate 10.

The top surface 12 of the mounting plate 10 also has a plurality of spacers 30 rotatably mounted on the top surface 12. Preferably there are four spacers 30 for maintaining the paint pad apparatus 8 at a uniform distance from a surface adjacent the surface being painted, so that when the paint pad 39 engages the paint, the borderline of the paint applied by the paint pad 39 is close to an edge where the adjacent surface and the surface being painted meet. The spacers 30 have preferably flat edges and are made of plastic, such as nylon or TEFLON (manufacture by DuPont, USA), although they may be made of other materials such as rubber. At least two spacers 30 extend outwardly beyond at least two sides of the mounting plate and at least two spacers 30 extend outwardly beyond only one side of the mounting plate. The extension of the spacers 30 is about 0.05 inches from the sides of the mounting plate. The purpose of the spacers is to keep paint from getting on the surface adjacent the surface being painted. Preferably, the mounting plate 10 is of rectangular shape and the spacers 30 are located at the corners of the rectangle. In another embodiment of the present invention, the shaft 32 of the handle 37 enters through the internal cavities of the upwardly extending projections 26 and 28, whereby the paint pad apparatus 8 is turned 90° allowing for greater flexibility when painting a surface necessitates a narrower paint pad.

Figure 3:
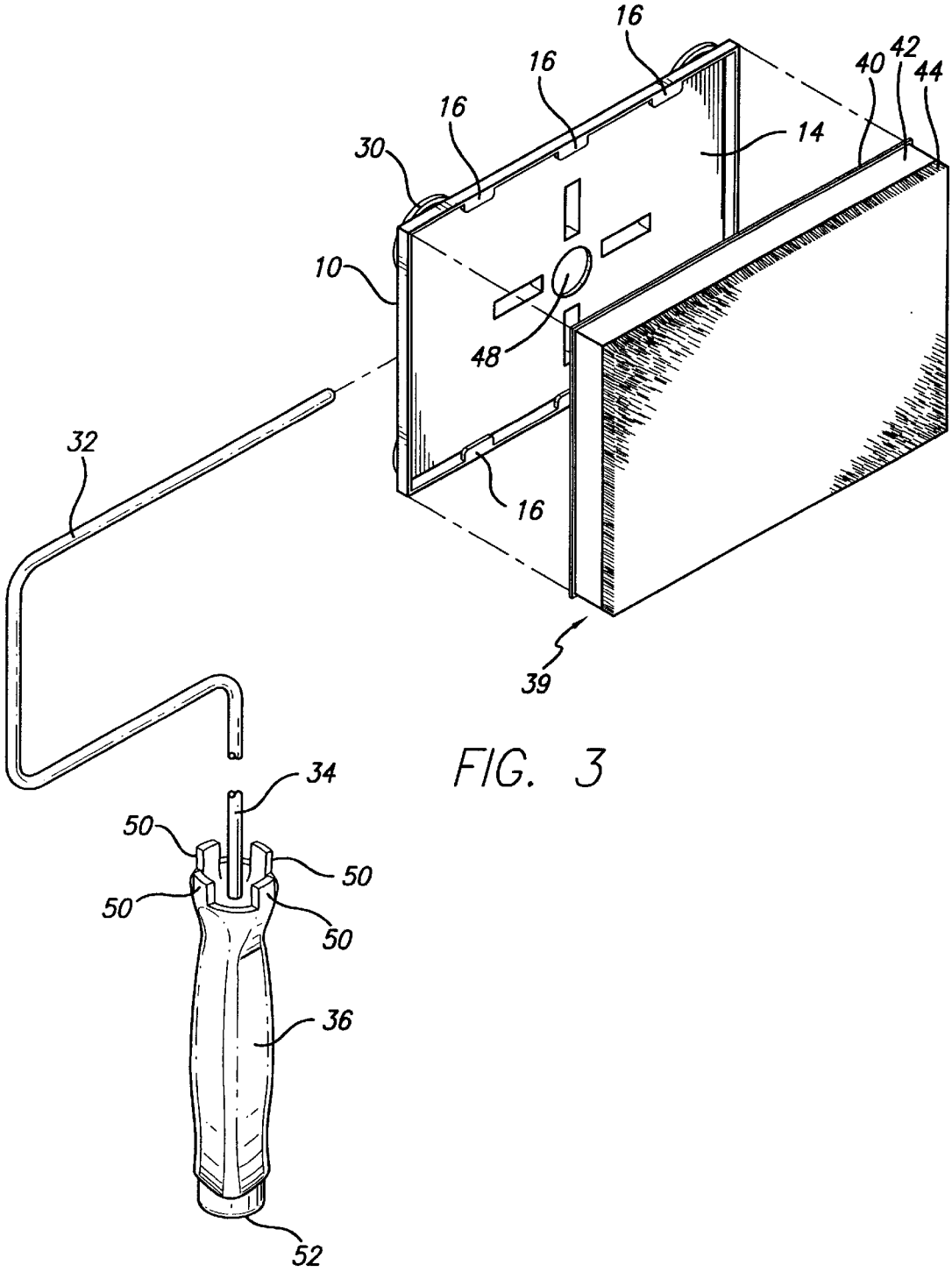
FIG. 3 is an exploded perspective view of the paint pad apparatus of FIG. 1 showing primarily the bottom face of the mounting plate and the removable paint pad side.

Referring to FIG. 3, the bottom surface 14 supports a paint absorbent pad 39. The paint absorbent pad 39 is mounted to the bottom surface 14 of the mounting plate 10 by snapping the peripheral edge 40 of the pad 39 under a plurality of tabs 16 extending outwardly from the bottom surface 14. The tabs 16 extend along at least two opposing sides of the peripheral edge of the mounting plate 10. Preferably there are three tabs 16 along one side of the mounting plate 10 and three tabs 16 along the opposing side of the mounting plate 10. The mounting plate 10 preferably has a push out hole 48 located in the center of the plate 10 for allowing the pad 39 to be pushed out and replaced with a new pad.

Figure 4:
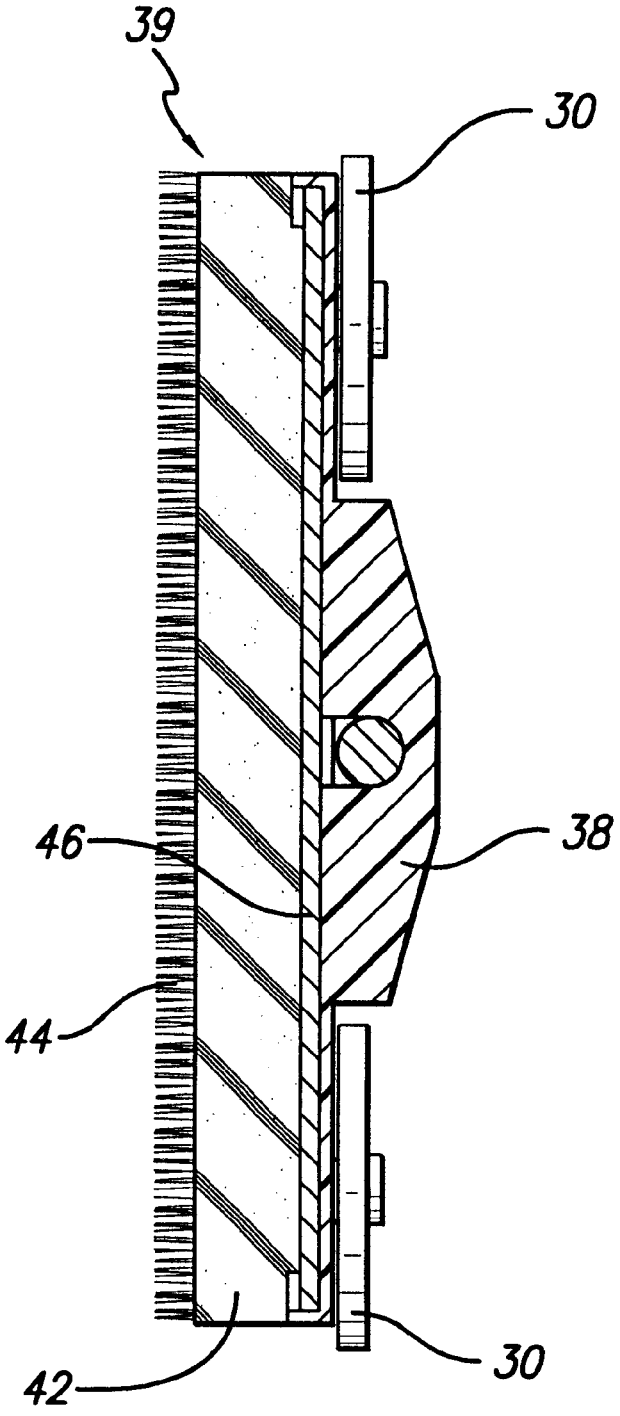
FIG. 4 is a cross-sectional view of the paint pad apparatus of FIG. 1 along 4—4.
Figure 5:
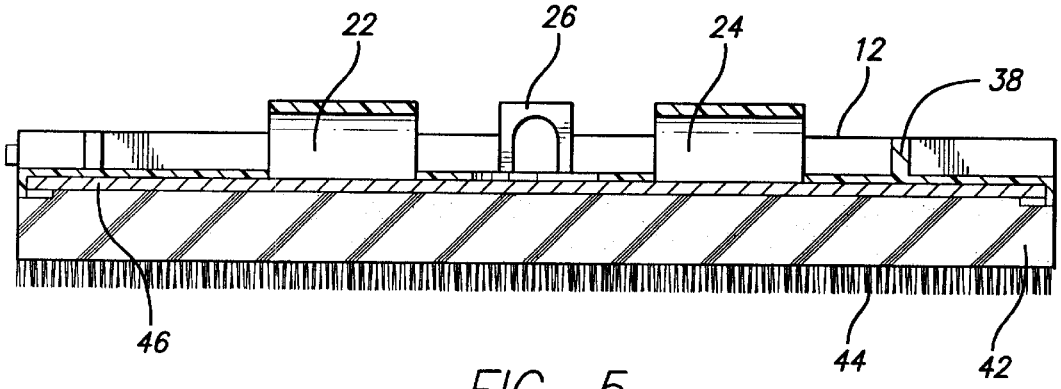
FIG. 5 is a cross-sectional view of the paint pad apparatus of FIG. 1 along 5—5.
Figure 6:
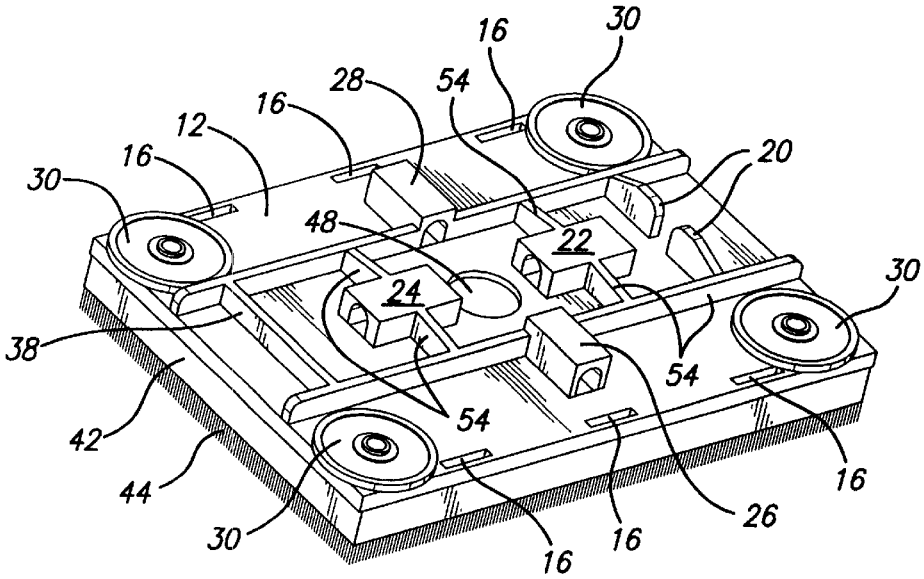
FIG. 6 is a perspective view of the paint pad apparatus of FIG. 1 showing primarily the top surface of the mounting plate, the opposing side of FIG. 3.

Referring to FIGS. 3 and 4, the paint pad 39 is shown as preferably comprising a support layer such as a flexible plastic backing 46 having a peripheral edges 40, a padding layer such as a foam layer 42, either open or closed cell foam, preferably composed of a polyurethane or polyester and bristles or pile and the like 44 suitably attached to the foam layer 42, e.g., by flocking. Preferably the pad uses bristles or other fibers to absorb and spread the paint, however, pile fabric or other pile may be used such as suitable for holding and dispensing a quantity of paint. If bristles are used it is preferred they be made of nylon or a natural material such as mohair. The paint pad 39 has preferably the same configuration as the mounting plate 10, e.g., a rectangular shape, which allows for efficient mounting of the paint pad 39 to the mounting plate 10. The peripheral edges 40 are seen to have four substantially straight sides, in this case in the shape of a rectangle. The peripheral edges of the paint pad 39 are pressed under the plurality of tabs 16 extending from the bottom surface 14 of the mounting plate 10 to mount the paint pad 39 to the mounting plate 10. The tabs 16 also press into the padding layer 42 which also hold the pad 39 to the mounting plate 10. When mounting the pad 39 to the plate 10, the peripheral edges of the pad 39 are placed under at least two opposing tabs 16 and the pad can slide past the remaining tabs 16.

The paint handle 37 comprises a first end of a shaft 32, which is inserted into the internal cavities of the upwardly extending projections 22, 24 or 26 and 28 and is rotatable. The shaft is preferably made of metal wire having a round cross-section, although a strong plastic may be substituted for the metal. The paint handle 37 further comprises a second end 34 of the shaft which is attached to a grip 36. The grip has two ends, on a first end the grip 36 has a substantially cylindrical, threaded internal cavity 52 to allow for threading an extender to the paint handle 37, in this way, surfaces such as ceilings can be reached with the apparatus. On the second end of the grip 36 are located a plurality of prongs 50. The prongs 50 allow the apparatus to be put down without having to touch the ground, for example, a prong 50 is able to hook over the edge of a paint can. Therefore, when the pad 39 is used the paint on the pad will not pick up unwanted debris. The grip 36 is preferably made of plastic, such as polypropylene, polyethylene, or nylon, although it may be made of other materials such as rubber. The grip 36 can also be texturized to provide a non-slip surface.

Although the foregoing invention has been described in some detail by way of illustration and example for purpose of clarity and understanding, it will be obvious that various modifications and changes which are within the knowledge of those skilled in the art are considered to fall within the scope of the appended claims.

REFERENCED ELEMENTS

8 Paint pad apparatus
10 Mounting plate
12 Face
14 Face
16 Mounting tabs
20 Alignment projections
22 First upwardly extending projection
24 Second upwardly extending projection
26 Third upwardly extending projection
28 Fourth upwardly extending projection
30 Spacer
32 Handle shaft
34 Wire
36 Handle grip

37 Handle
38 Stop block projection
39 Paint pad
40 Peripheral edge
42 Foam layer
44 Bristles
46 Pad backing
48 Center push hole
50 Prongs
52 Threaded internal cavity
54 Support projections

I claim:

1. A paint pad apparatus for applying paint to a surface comprising:

a mounting plate having a top and a bottom face;

a paint pad attached to the bottom face of the mounting plate;

a plurality of upwardly extending projections attached along the top face of the mounting plate, the projections having internal cavities capable of supporting an end portion of a shaft of a handle;

a stop block projection attached along the top face of the mounting plate, to stop the end portion of the shaft of the handle; and a plurality of spacers rotatably attached along the top face of the mounting plate for maintaining the paint pad apparatus at a uniform distance from a surface adjacent the surface being painted.

2. The paint pad apparatus of claim 1, further comprising at least two alignment projections attached along the top face of the mounting plate to allow alignment of a shaft of a handle.

3. The paint pad apparatus of claim 2, wherein the alignment projections, the upwardly extending projections, and the stop block projection are integrally attached to the top surface of the mounting plate.

4. The paint pad apparatus of claim 1, further comprising a plurality of tabs along the bottom face of the mounting plate, the tabs extend inwardly along at least two opposing peripheral edges of the mounting plate to allow mounting of the paint pad.

5. The paint pad apparatus of claim 1, wherein at least two spacers extend outwardly beyond at least two sides of the mounting plate and at least two spacers extend outwardly beyond one side of the mounting plate.

6. The paint pad apparatus of claim 1, wherein the mounting plate is in the shape of a rectangle.

7. The paint pad apparatus of claim 1, further comprising a removable handle, the handle having a shaft and a grip, the shaft having two end portions, a first end portion attached to the grip and the second end portion removably attached to the mounting plate.

8. The paint pad apparatus of claim 7, wherein the second end portion of the shaft is attached to the mounting plate by entrance through the cavities of at least two upwardly extending projections, whereby the upwardly extending projections support the second end portion of the shaft.

9. The paint pad apparatus of claim 8, wherein the second end portion of the shaft is attached to the mounting plate by entrance through the cavities of the first and second upwardly extending projections, and wherein the second end portion of the shaft butts up against the stop block projection.

10. The paint pad apparatus of claim 8, wherein the second end portion of the shaft is attached to the mounting plate by entrance through the cavities of the third and fourth upwardly extending projections.

11. The paint pad apparatus of claim 1, wherein the mounting plate, the plurality of upwardly extending projections, the stop block projection, and the alignment projections are made from a clear or colored plastic material.

12. A paint pad apparatus for applying paint to a surface comprising:

a mounting plate having a top and a bottom face;

a paint pad removably arranged to the bottom face of the mounting plate;

a plurality of tabs along the bottom face of the mounting plate, the tabs extend inwardly along at least two opposing peripheral edges of the mounting plate to allow mounting of the paint pad;

at least two alignment projections attached along the top face of the mounting plate to allow alignment of a shaft of a handle, a plurality of upwardly extending projections attached along the top face of the mounting plate, the projections having internal cavities capable of supporting the shaft of the handle;

a stop block projection attached along the top face of the mounting plate, to stop an end of the shaft of the handle; and a plurality of spacers rotatably attached along the top face of the mounting plate for maintaining the paint pad apparatus at a uniform distance from a surface adjacent the surface being painted, so that when said pad engages the paint the borderline of the paint applied by the paint pad is close to an edge where the adjacent surface and the surface being painted meet, wherein at least two spacers extend outwardly beyond at least two sides of the mounting plate and at least two spacers extend outwardly beyond one side of the mounting plate.

13. The paint pad apparatus of claim 12, wherein the mounting plate is in the shape of a rectangle.

14. The paint pad apparatus of claim 12, further comprising a removable handle, the handle having a shaft and a grip, the shaft having two end portions, a first end portion attached to the grip and the second end portion removably attached to the mounting plate.

15. The paint pad apparatus of claim 14, wherein the second end portion of the shaft is attached to the mounting plate by entrance through the cavities of at least two upwardly extending projections, whereby the upwardly extending projections support the second end portion of the shaft.

16. The paint pad apparatus of claim 15, wherein the second end portion of the shaft is attached to the mounting plate by entrance through the cavities of the first and second upwardly extending projections, and wherein the second end portion of the shaft butts up against the stop block projection.

17. The paint pad apparatus of claim 15, wherein the second end portion of the shaft is attached to the mounting plate by entrance through the cavities of the third and fourth upwardly extending projections.

18. The paint pad apparatus of claim 12, wherein the mounting plate, the plurality of upwardly extending projections, the stop block projection, and the alignment projections are made from a clear or colored plastic material.

* * * * *